US011190881B2

(12) United States Patent
Niblock et al.

(10) Patent No.: US 11,190,881 B2
(45) Date of Patent: Nov. 30, 2021

(54) PIEZOELECTRIC TRANSDUCER

(71) Applicant: uBeam Inc., Marina Del Rey, CA (US)

(72) Inventors: Trevor Niblock, Agoura, CA (US); Iman Shahosseini, Woodland Hills, CA (US); Wade Smith, Santa Monica, CA (US)

(73) Assignee: uBeam Inc., Marina del Rey, CA (US)

( * ) Notice: Subject to any disclaimer, the term of this patent is extended or adjusted under 35 U.S.C. 154(b) by 0 days.

(21) Appl. No.: 16/430,904

(22) Filed: Jun. 4, 2019

(65) Prior Publication Data

US 2020/0389739 A1 Dec. 10, 2020

(51) Int. Cl.
*H04R 17/00* (2006.01)
*H04R 7/18* (2006.01)

(52) U.S. Cl.
CPC ..... *H04R 17/00* (2013.01); *H04R 7/18* (2013.01)

(58) Field of Classification Search
CPC ..... H04R 1/06; H04R 17/00; H04R 17/005; H04R 17/02; H04R 17/025; H04R 2217/00; H04R 2217/01; H01L 41/0475
See application file for complete search history.

(56) References Cited

U.S. PATENT DOCUMENTS 2,592,703 A * 4/1952 Jaffe ..... H04R 17/00 310/328
2,931,865 A * 4/1960 Dvorsky ..... H04R 17/02 381/173
3,287,692 A * 11/1966 Turner ..... H04R 17/00 367/161
3,538,232 A * 11/1970 Knauert ..... G10H 3/146 84/731
3,588,381 A * 6/1971 Schafft ..... H04R 17/00 381/190
3,707,131 A * 12/1972 Massa ..... H04R 17/10 310/324
4,063,049 A * 12/1977 Pipitone ..... H04R 7/22 381/351
4,593,160 A * 6/1986 Nakamura ..... H04R 17/00 310/324
4,597,099 A * 6/1986 Sawafuji ..... H04R 17/00 310/313 D
4,654,554 A * 3/1987 Kishi ..... H04R 1/22 310/322
6,747,395 B1 * 6/2004 Satoh ..... H04R 17/005 310/324

(Continued)

FOREIGN PATENT DOCUMENTS

GB 1383078 A * 2/1975 ..... H04R 17/025
JP 57208796 A * 12/1982 ..... H04R 17/00

*Primary Examiner* — Ryan Robinson
(74) *Attorney, Agent, or Firm* — Butzel Long

(57) ABSTRACT

Systems and techniques are provided for a piezoelectric transducer. A base plate includes a first electrical contact and a second electrical contact. A transduction element is mounted directly on the base plate and electrically connected to the first electrical contact. A spacer includes a via. The via includes electrically conductive material. The spacer is mounted on the base plate around the transduction element and the electrically conductive material of the via is electrically connected to the second electrical contact. A diaphragm is mounted on the spacer and on the transduction element.

17 Claims, 12 Drawing Sheets

(56) References Cited

U.S. PATENT DOCUMENTS

| | | | | |
|---|---|---|---|---|
| 7,141,919 | B1 * | 11/2006 | Hamada | H04R 17/00 310/348 |
| 7,259,502 | B2 * | 8/2007 | Kami | H04R 1/06 310/324 |
| 7,521,847 | B2 * | 4/2009 | Heim | H04R 1/06 310/324 |
| 9,973,857 | B2 * | 5/2018 | Tokuhisa | H04R 1/22 310/322 |

* cited by examiner

PIEZOELECTRIC TRANSDUCER

BACKGROUND

Piezoelectric transducers may be used to generate soundwaves at various frequencies, including ultrasonic frequencies. The structure of and materials used in a piezoelectric transducer may affect the performance and lifespan of the piezoelectric transducer.

BRIEF SUMMARY

According to an implementation of the disclosed subject matter, a base plate may include a first electrical contact and a second electrical contact. A transduction element may be mounted directly on the base plate and electrically connected to the first electrical contact. A spacer may include a via. The via may include electrically conductive material. The spacer may be mounted on the base plate around the transduction element and the electrically conductive material of the via may be electrically connected to the second electrical contact. A diaphragm may be mounted on the spacer and on the transduction element.

Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1A:
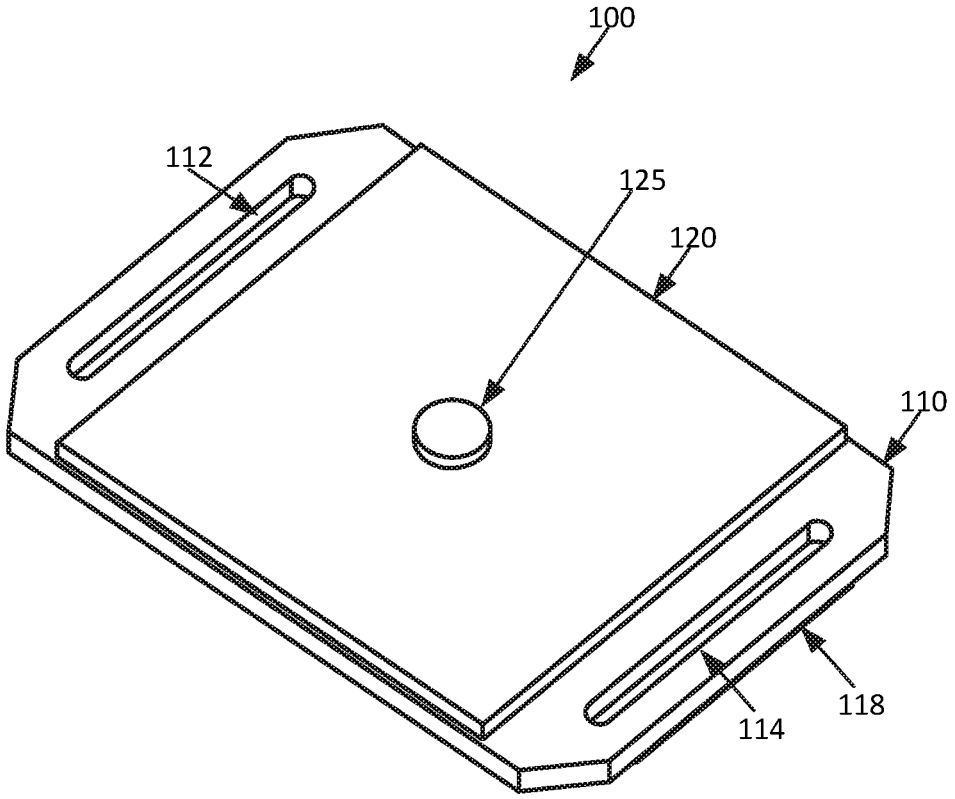
FIG. 1A shows an example transduction element according to an implementation of the disclosed subject matter.

A piezoelectric transducer may include a transduction element, an acoustic impedance matching component, or diaphragm, and a spacer. The transduction element may be a biomorph structure that includes a piece of piezoelectric material mounted on top of an elastic layer. The transduction element may be mounted on a base plate which may provide electrical connections to the transduction element. A spacer may be mounted on the base plate. A diaphragm made of an electrically conductive material may be mounted on top of the piece of piezoelectric material at the center of the diaphragm. The perimeter of the diaphragm may be mounted on top of the spacer. A waveguide and protection grid may be added on top of the diaphragm or the spacer. The piezoelectric transducer may be able to generate sounds waves at various frequencies, including ultrasonic frequencies, and may be able to generate power by receiving sounds waves of various frequencies, including ultrasonic frequencies.

The transduction element of a piezoelectric transducer may be a bimorph structure that may include a piece of piezoelectric material mounted on top of an elastic layer. The piece of piezoelectric material may be made of any suitable piezoelectric material or electrically active material, such as any suitable piezoceramic. The piece of piezoelectric material may be any suitable shape and may have any suitable dimensions. For example, the piece of piezoelectric material may be rectangular and thin, and may have dimensions, for example, of 5.8 mm long×5.8 mm wide×0.19 mm high. The elastic layer may be made of any suitable elastic material, such as, for example, iron-nickel alloys such as invar, aluminum, silicon, titanium, nickel, brass, steel, magnesium, or copper. The elastic layer may have any suitable shape and may any suitable dimensions. For example, the elastic layer may be rectangular and may be bigger than the piece of piezoelectric material, may be an irregular octagon shaped as rectangle with its corners cut and with cutouts at opposing ends, or may be a rectangle with inwardly curved edges and rounded corners. The elastic layer may have cutouts or tethered suspensions which may be used for frequency and performance tuning of the piezoelectric transducer. The piece of piezoelectric material may be mounted onto the elastic layer in any suitable manner, such as, for example, through the use of any suitable adhesive or bonding process. Adhesive may be placed in any suitable location and in any suitable quantity to bond the piece of piezoelectric material to the elastic layer to form the transduction element. The adhesive may be, for example, electrically conductive adhesive.

The transduction element may be mounted on a base plate, or mounting board, which may provide electrical connections to the transduction element. The transduction element may be mounted on the base plate in any suitable manner, such as, for example, through adhesive of any suitable type and quantity placed at any suitable location on the elastic layer of the transduction element and/or the base plate. For example, adhesive may be placed near opposite edges of an elastic layer that is an irregular octagon or may be placed on the rounded corners of an elastic layer that is rectangular with inwardly curved edges rounded corners. The adhesive may be electrically conductive. The transduction element may be mounted onto the base plate so that there is small air gap between any portion of the bottom of surface of the elastic layer that is not covered by adhesive and the base plate.

The base plate, or mounting board, may provide electrical connections to the transduction element. For example, the base plate may include electrical contacts on its top surface for vias that go through to the bottom surface of the base plate. Adhesive on the elastic layer of the transduction element may be placed in contact with one of the electrical contacts when the transduction element is mounted to the base plate, establish an electrical connection between the electrical contact and the transduction element. The base plate may be in any suitable shape, such as, for example, a hexagon, and have any suitable thickness. The base plate may be made of any suitable material, and may be, for example, a PCB with any suitable number of layers. The base plate may include any suitable electrical and electronic components and circuits for providing power to, receiving power from, and controlling the transduction element. Electronics and circuits may be located, for example, on the opposite surface of the base plate from the surface on which the transduction element is mounted.

A spacer may be mounted on the base plate. The spacer may be made of any suitable material such as PCB, plastics, silicones, metals or alloys, ceramics, fiberglass, carbon fiber, or any types of polymers. The spacer may be in any suitable shape or form, such as, for example, a ring shape, a number of pillars, or a hexagon. The shape of the perimeter of the spacer may match the shape of the perimeter of the base plate. The spacer may be mounted to the base plate around the transduction element. The spacer may be mounted to the base plate in any suitable manner, including, for example, through adhesive that may be electrically conductive. The spacer may include a number of vias. The vias may be through holes in the spacer filled with an electrically conductive material. The spacer may be mounted to the base plate so that vias of the spacer are in contact with the electrical contacts on the top surface of the base plate. An electrically conductive adhesive may adhere the electrically conductive material in the via of the spacer to the electrical contact of the base plate, electrically connecting the via of the spacer to the via of the base plate.

A diaphragm made of an electrically conductive material may be mounted on top of the spacer and on top of the piece of piezoelectric material at the center of the diaphragm. The diaphragm may be made of any suitable electrically conductive material, such as, for example, aluminum. The diaphragm may be in any suitable shape, such as, for example, a cup or bowl shape. The diaphragm may be mounted onto the piece of piezoelectric material of the transduction element in any suitable manner, for example, using any suitable adhesive. The adhesive may be placed in any suitable location and used in any suitable quantity. For example, electrically conductive adhesive may be placed at the center of the top surface of the piece of piezoelectric material and may used to bond the center of the diaphragm to the piece of piezoelectric material. The center of the diaphragm may be the center of the cup shape, which have any suitable depth and curvature. The diaphragm may also be mounted to the spacer. For example, the perimeter of the diaphragm may be bonded to the spacer using any suitable electrically conductive adhesive. The adhesive may be placed, for example, on top of the spacer or on the bottom of the perimeter of the diaphragm, including on top of the electrically conductive material in a via of the spacer. This may establish an electrical connection between the diaphragm and an electrical contact of the base plate through the electrically conductive material in the via and the electrically conductive adhesive. The portion of the perimeter of the diaphragm that is bonded to or resting on the spacer may include cutouts. Bonding all or a portion of the perimeter of the diaphragm to the spacer may increase the durability of the diaphragm and improve the diaphragm's resistance to imposed vibrations and mechanical stress.

The piezoelectric transducer may include a circuit that may allow electrical signals to be applied to the transduction element without wire or wire-bond. The circuit may be from a first electrical contact of the base plate through the electrically conductive adhesive between electrical contact and the electrically conductive material in the via of the spacer and then through the electrically conductive material in the via of the spacer, through the electrically conductive adhesive between the electrically conductive material in the via and the diaphragm, through the diaphragm, through the electrically conductive adhesive between the diaphragm and the piece of piezoelectric material on top of the transduction element, through the elastic layer on the bottom of the transduction element, through the electrically conductive adhesive between the elastic layer and a second electrical contact of the base plate, and from the second electrical contact to a power source, power storage, and/or electrical load and back to the first electrical contact on the base plate. Any suitable electrical or electronic components and circuits may be arranged in any suitable manner between the first and second electrical contacts and the power source, power storage, and/or electrical load. For example, the first and second electrical contacts may be connected to a battery. The battery may be able to supply electrical voltage to cause the piece of piezoelectric material to flex, in turn flexing the diaphragm and producing sound waves. The battery may also be able to store electrical energy based on voltage generated by flexing of the piezoelectric material caused by sound waves that cause the diaphragm to flex. The battery may serve as a power source and power storage. The power source and power storage may also be, for example, capacitor, super-capacitor, or a circuit connected to an outside power source, such as a wall outlet. An electrical load may be, for example, any suitable electronic or electric devices or components, such as, for example, the components of a computing device such as a smartwatch, smartphone, tablet, or laptop, or smart television, an amplifier or powered speaker system, any IOT device such as sensor tags or GPS trackers, RFID sensors, security cameras, or wireless keyboards and mice, or an appliance of any suitable type.

The amount of polymer material, such as silicone or epoxy, used in the piezoelectric transducer may be minimal. This may reduce structural damping in the piezoelectric transducer, resulting in improved performance.

In some implementations, the diaphragm and the spacer may be a single integral piece made of an electrically conductive material. The single piece may have a diaphragm portion and a spacer portion. The center of the single piece diaphragm and spacer, which may be the center of the diaphragm portion, may be bonded to the center of the piece of piezoelectric material at the top of the transduction element. The bottom of the single piece, which may be the bottom of the spacer portion, may be bonded to the base plate using an electrically conductive adhesive.

In some implementations, a waveguide and protection grid may be placed on top of the diaphragm. The waveguide and protection grid may provide mechanical protection to the diaphragm while improving the efficiency of the piezoelectric transducer. The waveguide may, for example, be attached to the diaphragm above the locations where the diaphragm is attached to the spacer, for example, on the perimeter of the diaphragm. The protection grid may be attached to the top of the waveguide. In some implementations, the waveguide, protection grid, and diaphragm may be a single integral piece. The waveguide and protection grid may be made from any suitable materials, such as, for example, plastics, silicones, papers, cloths, fiberglass, carbon fiber, metals or alloys, ceramics, or any types of polymers. The waveguide guide may have any suitable shape. For example, the waveguide may be a ring or hexagon with walls of a tapered thickness that may be thicker at the base of the waveguide and thinner at the top of the waveguide. The protection grid may be a grid of any suitable type and grid pattern, with any suitable grid density.

A piezoelectric transducer array may include any number of piezoelectric transducers. The piezoelectric transducers may share a common base plate or may use any suitable number of separate pieces of material, for example, with each piezoelectric transducer having its own separate base plate which may be attached to other base plates. The piezoelectric transducers of a piezoelectric transducer array may be arranged in any suitable pattern. For example, a piezoelectric transducers array with piezoelectric transducers with hexagonal base plates and spacers may use hexagonal tiling. Piezoelectric transducers in the same piezoelectric transducer array may share electrical and electronic components, including components and circuits for controlling, providing power to, and receiving power from transduction elements of the piezoelectric transducers.

Figure 1B:
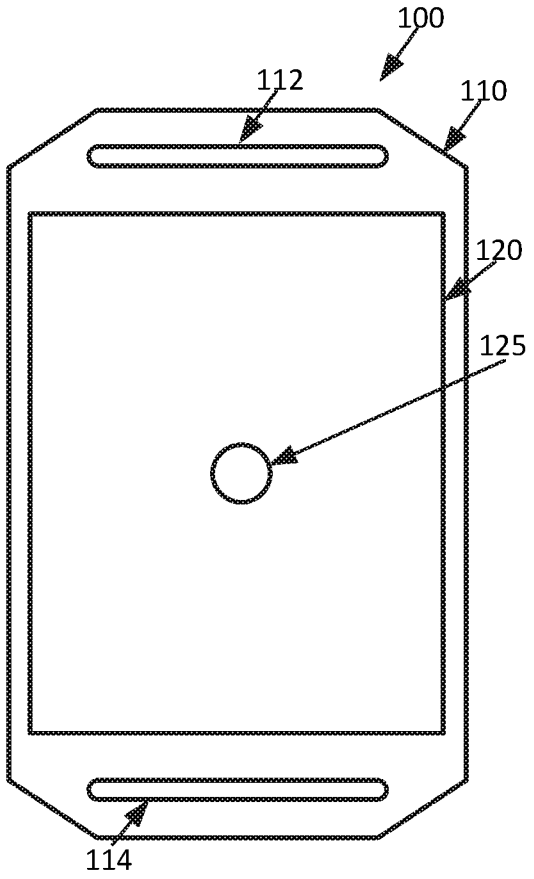
FIG. 1B shows an example transduction element according to an implementation of the disclosed subject matter.
Figure 1C:
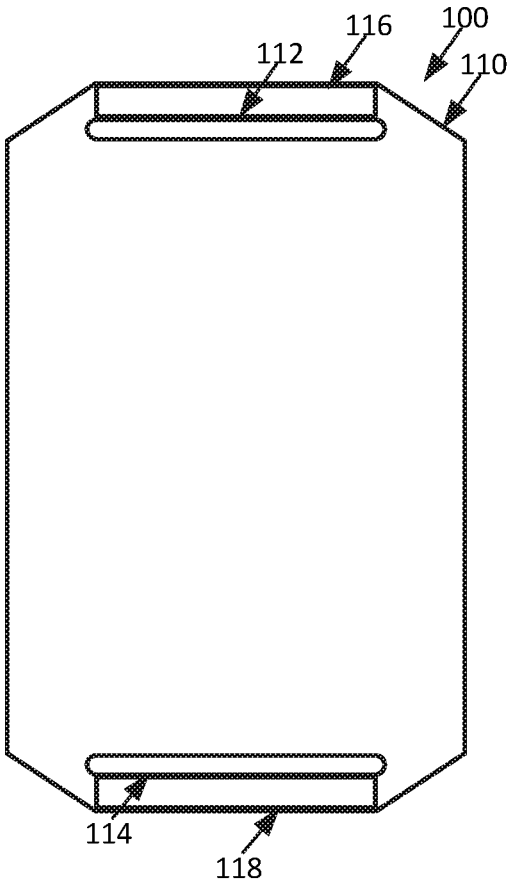
FIG. 1C shows an example transduction element according to an implementation of the disclosed subject matter.

FIG. 1A, FIG. 1B and FIG. 1C show an example transduction element according to an implementation of the disclosed subject matter. A transduction element 100 of a piezoelectric transducer may be a bimorph structure that may include a piece of piezoelectric material 120 mounted on top of an elastic layer 110. The piece of piezoelectric material 120 may be made of any suitable piezoelectric material or electrically active material, such as any suitable piezoceramic. The piece of piezoelectric material 120 may be any suitable shape and may have any suitable dimensions. For example, the piece of piezoelectric material 120 may be rectangular and thin, and may have dimensions, for example, of 5.8 mm long×5.8 mm wide×0.19 mm high. The elastic layer 110 may be made of any suitable elastic material, such as, for example, iron-nickel alloys such as invar, aluminum, silicon, titanium, nickel, brass, steel, magnesium, or copper. The elastic layer 110 may have any suitable shape and any suitable dimensions. For example, the elastic layer 110 may be an irregular octagon that may be bigger than the piece of piezoelectric material 120, such that the piece of piezoelectric material 120 may be placed on the elastic layer 110 without overhanging any part of the elastic layer 110. The elastic layer 110 may have cutouts 112 and 114, or tethered suspensions, at opposite ends of the elastic layer 110. The cutouts 112 and 114 may be used for frequency and performance tuning of the piezoelectric transducer.

Adhesive 125 may be applied to the top of the piece of piezoelectric material 120 at any suitable location, such as, for example, at the center of the piece of piezoelectric material 120. The adhesive 125 may be used to bond the transduction element 100 to a diaphragm. The adhesive 125 may be any suitable adhesive, including, for example, an electrically conductive adhesive. Adhesive 116 and 118 may be applied to the bottom of the elastic layer 120 at any suitable location, such as, for example, between each of the cutouts 112 and 114 and the edge of the elastic layer 110. The adhesive 116 and 118 may be used to bond the transduction element 100 to a base plate, or mounting board. The adhesive 116 and 118 may be any suitable adhesive, including, for example, an electrically conductive adhesive.

Figure 1D:
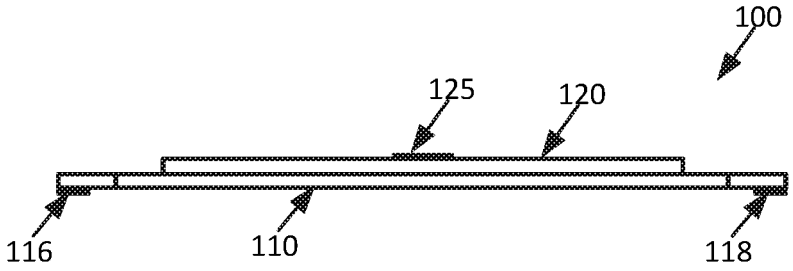
FIG. 1D shows an example cross-section of a transduction element according to an implementation of the disclosed subject matter.

FIG. 1D shows an example cross-sectional view of a transduction element according to an implementation of the disclosed subject matter. The piece of piezoelectric material 120 may be bonded to the elastic layer 110 in any suitable manner, such as, for example, through the use of any suitable adhesive or any suitable bonding process. Adhesive may be placed in any suitable location and in any suitable quantity to bond the piece of piezoelectric material 120 to the elastic layer 110 to form the transduction element 100. The elastic layer 110 and piece of piezoelectric material 120 may be of any suitable thickness.

Figure 2A:
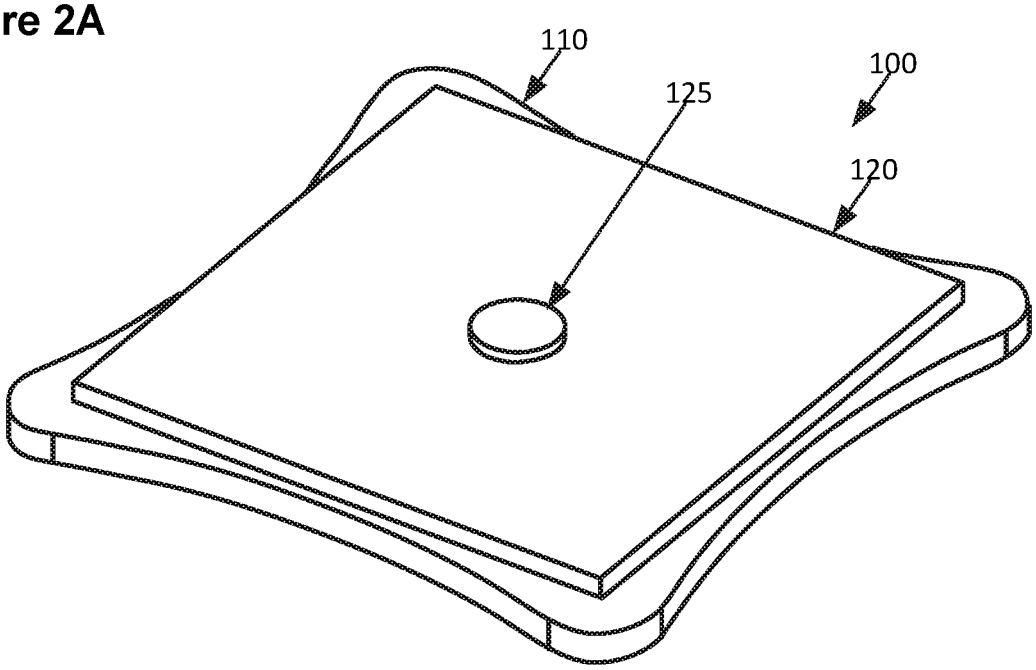
FIG. 2A shows an example transduction element according to an implementation of the disclosed subject matter.
Figure 2B:
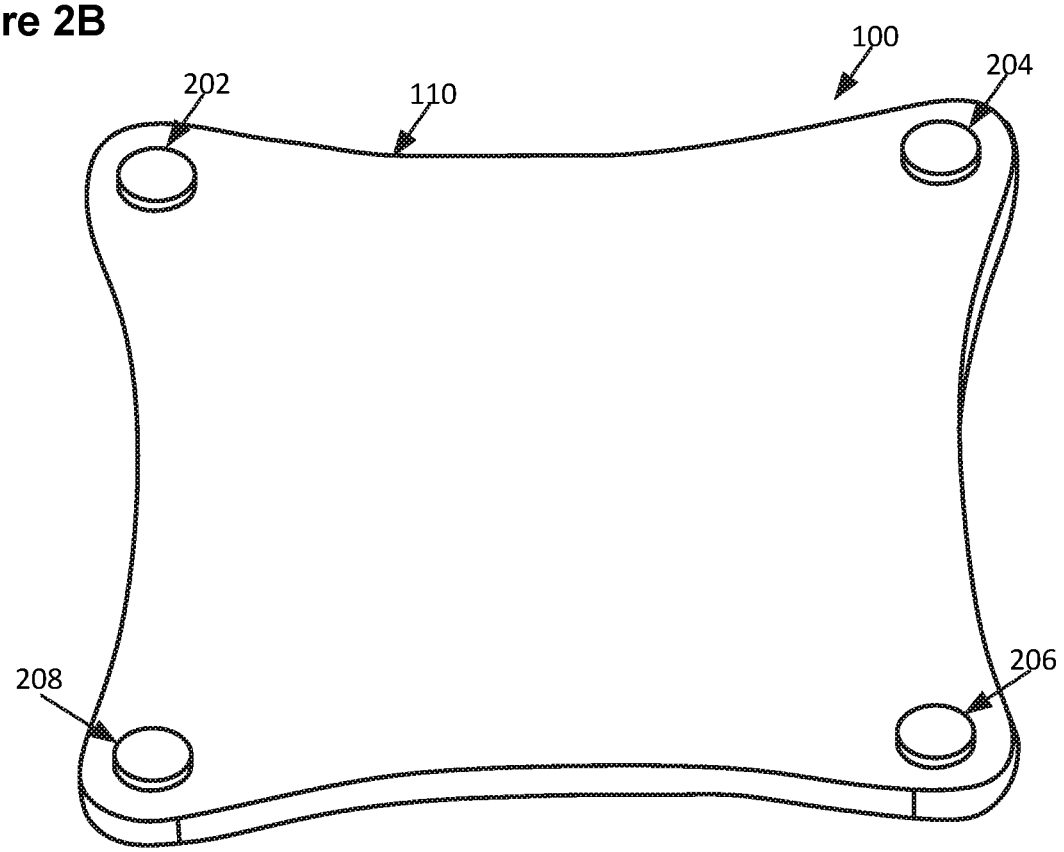
FIG. 2B shows an example transduction element according to an implementation of the disclosed subject matter.

FIG. 2A and FIG. 2B show an example transduction element according to an implementation of the disclosed subject matter. The elastic layer 110 of the transduction element 100 may have other suitable shapes. For example, the elastic layer 110 may be a rectangle with inwardly curved edges and rounded corners. Adhesive 202, 204, 206, and 208 may be placed on the corners of the underside of the elastic layer 210 that has inwardly curved edges with rounded corners.

Figure 3A:
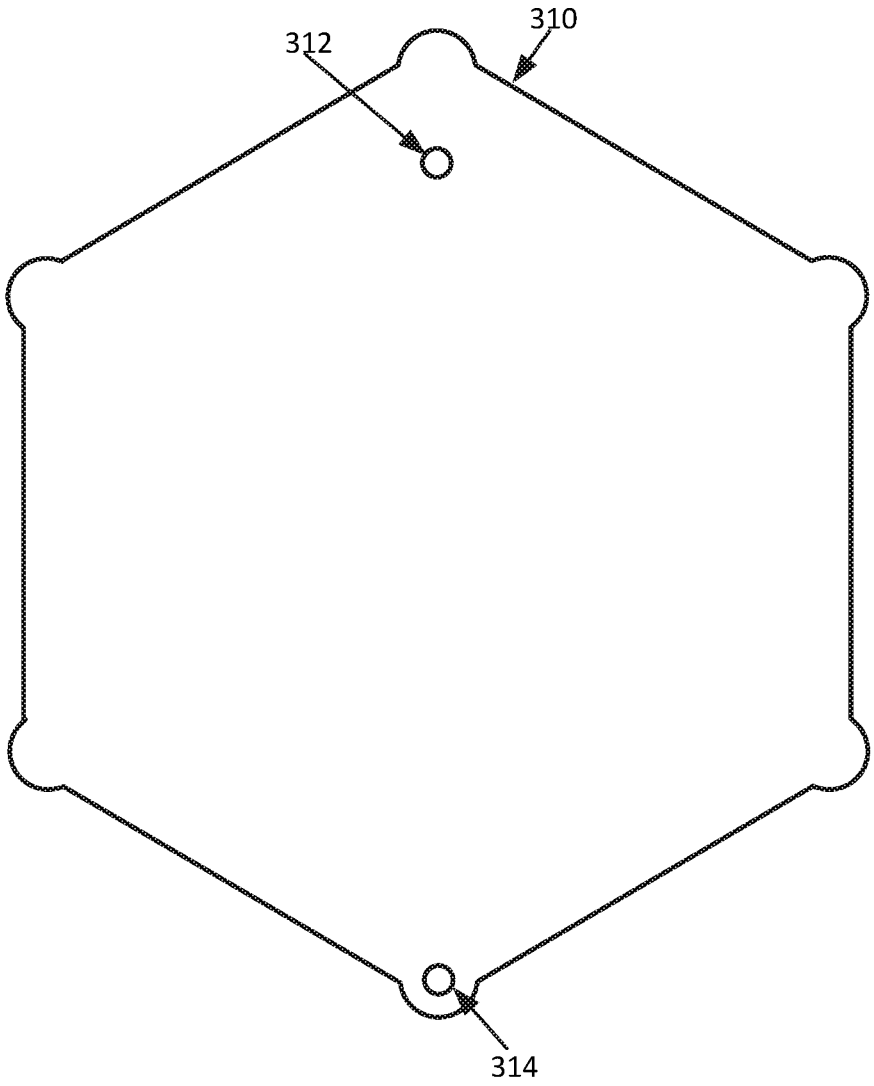
FIG. 3A shows an example base plate according to an implementation of the disclosed subject matter.

FIG. 3A shows an example base plate according to an implementation of the disclosed subject matter. A base plate 310 may provide electrical connections to the transduction element 100. The base plate 310 may be made of any suitable material, and may be, for example, a PCB with any suitable number of layers. The base plate 310 may include electrical contacts 312 and 314. The electrical contacts 312 and 314 may provide an electrical connection from a top surface of the base plate 310 to any layers of the base plate 310, including, for example, to the bottom surface of the base plate 310, through vias in the base plate 310. The base plate 310 may include any suitable electrical and electronic components and circuits for providing power to, receiving power from, and controlling the transduction element. Electronics and circuits may be located, for example, on the opposite surface of the base plate 310 from the surface on which the transduction element 100 may be mounted.

The transduction element 100 may be mounted to the base plate 310 in any suitable manner, such as, for example, with adhesives of any suitable type and quantity placed at any suitable location on the elastic layer 110 of the transduction element 100. The adhesive 116 and 118 may be electrically conductive. The transduction element 100 may be mounted to the base plate 310 so that, for example, the adhesive 116 is in contact with the electrical contact 312.

Figure 3B:
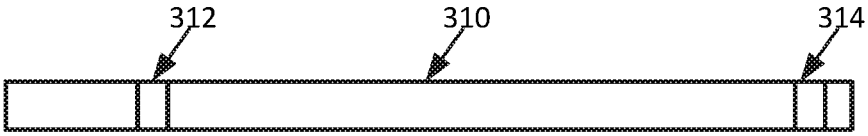
FIG. 3B shows an example cross-sectional view of a base plate according to an implementation of the disclosed subject matter.

FIG. 3B shows an example cross-sectional view of a base plate according to an implementation of the disclosed subject matter. The base plate 310 may be of any suitable thickness. The electrical contact 314 may be located closer to an edge of the base plate 310 than the electrical contact 312. Both the electrical contacts 312 and 314 may provide an electrical connection from one surface of the base plate 310 to another or may, for example, provide electrical connection to an interior layer of a PCB of the base plate 310.

Figure 4A:
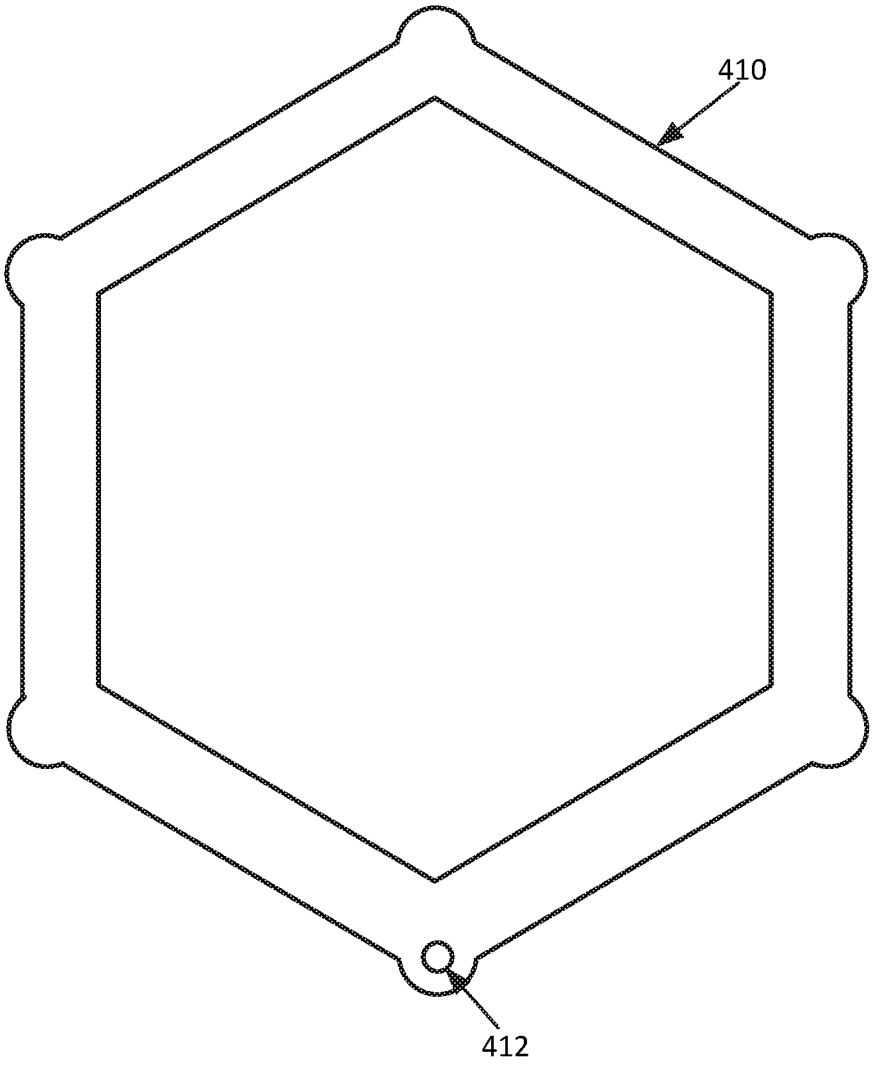
FIG. 4A shows an example spacer according to an implementation of the disclosed subject matter.

FIG. 4A shows an example spacer according to an implementation of the disclosed subject matter. A spacer 410 may be mounted on the base plate 310. The spacer 410 may be made of any suitable material, such as, for example, a non-electrically conductive material. The spacer 410 may be in any suitable shape or form, such as, for example, a ring shape or hexagon shape, or may be a number of pillars. The spacer may be mounted to the base plate 310 around the transduction element 100. The spacer 410 may be mounted to the base 100 plate in any suitable manner, including, for example, through an electrically conductive adhesive. The spacer 410 may include a number of vias, such as a via 412. The via 412 may be a through-hole in the spacer 410 that may be filled with an electrically conductive material. The spacer 410 may be mounted to the base plate 310 so that, for example, the via 412 is in contact with the electrical contact 314 of the base plate 310.

Figure 4B:
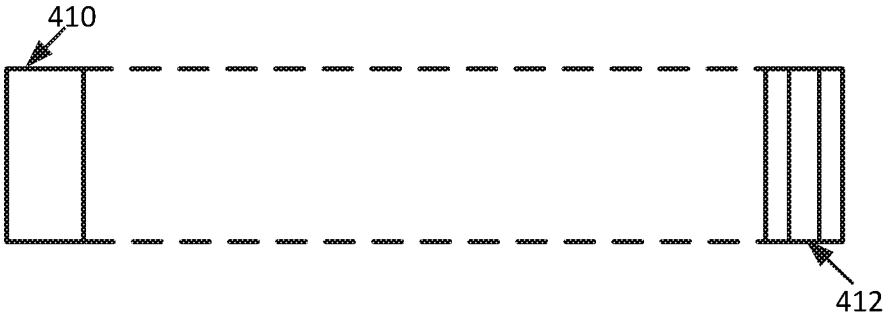
FIG. 4B shows an example cross-sectional view of a spacer according to an implementation of the disclosed subject matter.

FIG. 4B shows an example cross-sectional view of a spacer according to an implementation of the disclosed subject matter. The via 412 may extend entirely through the thickness of the spacer 410, such that the electrically conductive material in the via 412 may be contactable on both the top and bottom of the spacer 410. The spacer 410 may include any suitable number of vias.

Figure 5A:
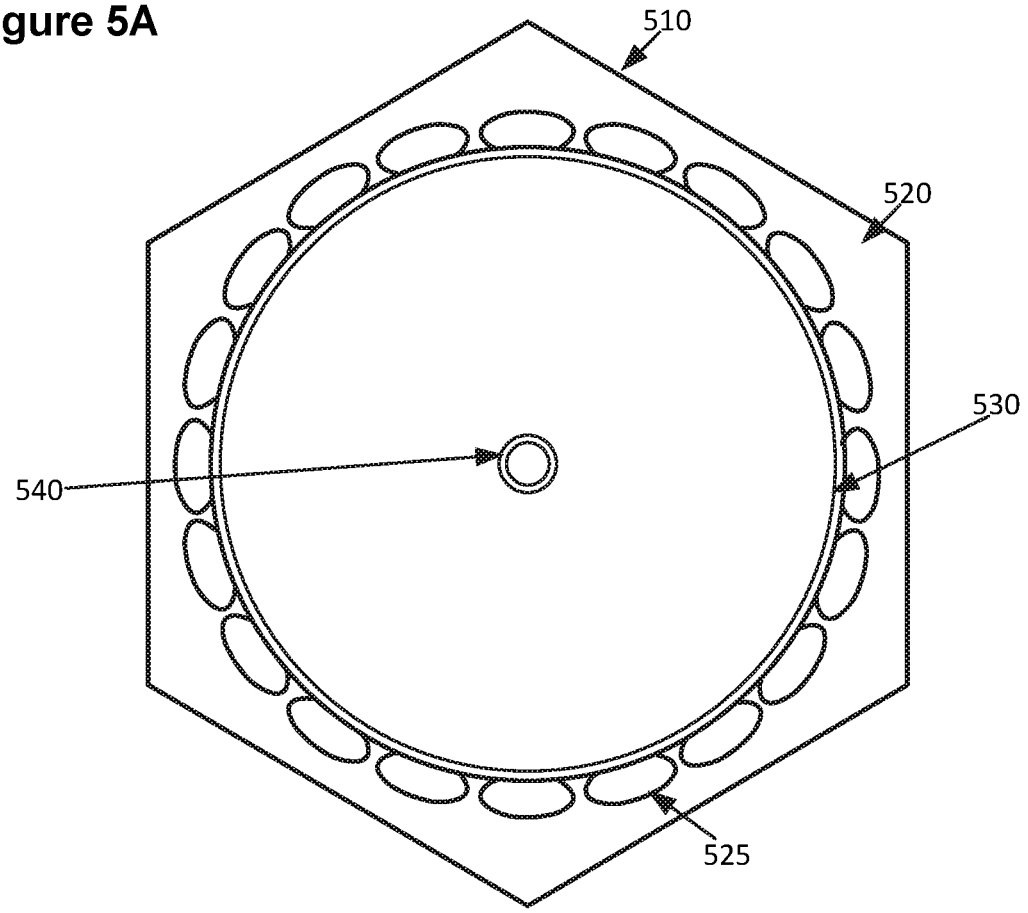
FIG. 5A shows an example diaphragm according to an implementation of the disclosed subject matter.

FIG. 5A shows an example diaphragm according to an implementation of the disclosed subject matter. A diaphragm 510 may be made of any suitable electrically conductive material, such as, for example, aluminum. The diaphragm 510 may be in any suitable shape, such as, for example, a cup or bowl shape. The diaphragm 510 may include a perimeter 520, which may be any suitable shape, such as, for example hexagonal, and may include a number of cutouts 525. The cutouts 525 in the perimeter 520 of the diaphragm 510 may be arranged around the circumference of a cup 530. The bottom of the cup 530 may include a cutout 540. Adhesive 552 may be placed under the perimeter 520 of the diaphragm 510.

Figure 5B:
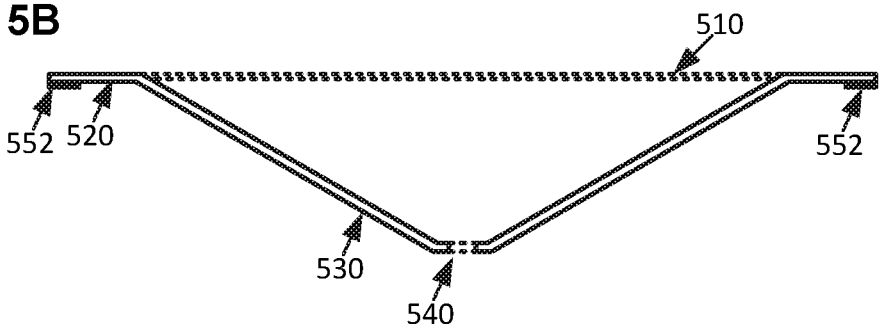
FIG. 5B shows an example cross-sectional view of a diaphragm according to an implementation of the disclosed subject matter.

FIG. 5B shows an example cross-sectional view of a diaphragm according to an implementation of the disclosed subject matter. The cup 530 may be a cup or bowl-shaped portion of the diaphragm 510 of any suitable depth and with any suitable curvature from the top of the diaphragm 510 to the cutout 540. The cutout 540 may be located on a flattened section of the cup 530 centered at the bottom of the cup 530.

Figure 6A:
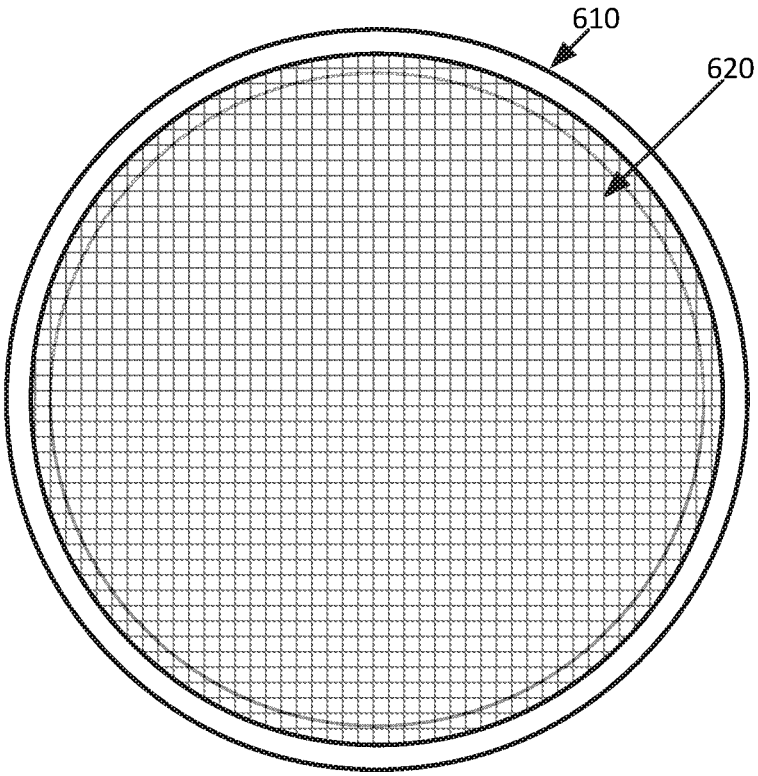
FIG. 6A shows an example waveguide according to an implementation of the disclosed subject matter.

FIG. 6A shows an example waveguide according to an implementation of the disclosed subject matter. A waveguide 610 and protection grid 620 may provide mechanical protection to the diaphragm 510 while improving the efficiency of the piezoelectric transducer. The waveguide 610 may be any suitable shape with an opening at its center, such as, for example, a ring shape. The protection grid 620 may be attached to the top of the waveguide 610. The protection grid 620 may be a grid of any suitable density and pattern and may be made of any suitable material. The waveguide 610 and protection grid 620 may be made from any suitable materials, such as, for example, plastics, silicones, papers, cloths, fiberglass, carbon fiber, metals or alloys, ceramics, or any types of polymers.

Figure 6B:
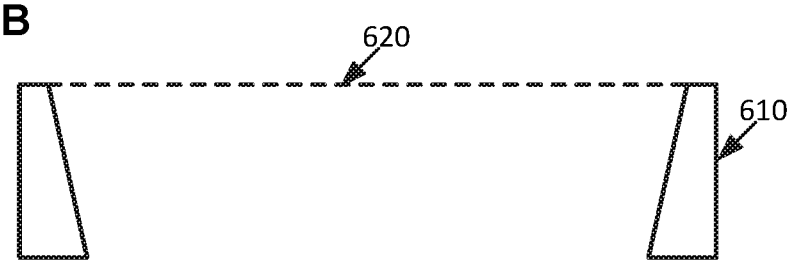
FIG. 6B shows an example cross-sectional view of a waveguide according to an implementation of the disclosed subject matter.

FIG. 6B shows an example cross-sectional view of a waveguide according to an implementation of the disclosed subject matter. The walls of the waveguide 610 may be tapered. The walls of the waveguide 610 may, for example, be thicker at the base of the waveguide 610 and thinner at the top of the waveguide 610 where the protection grid 620 is attached.

Figure 7A:
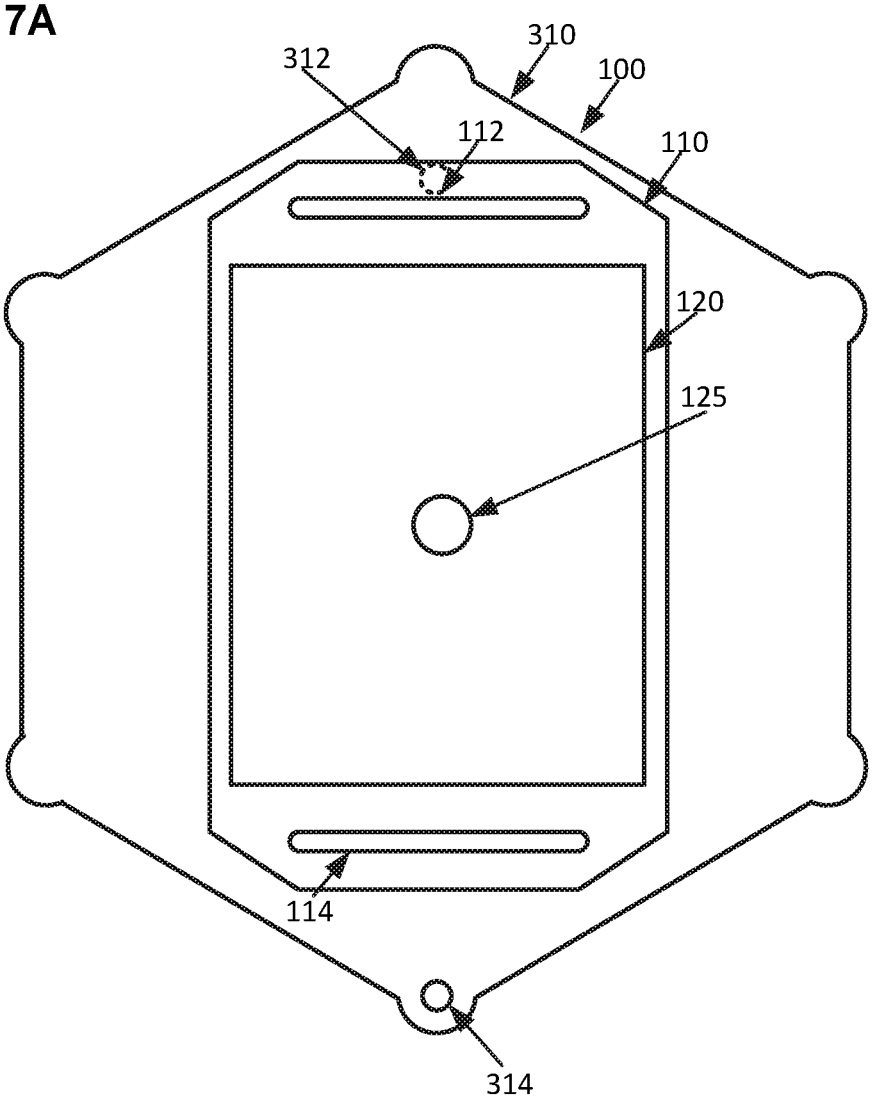
FIG. 7A shows an example transduction element and base plate according to an implementation of the disclosed subject matter.

FIG. 7A shows an example transduction element and base plate according to an implementation of the disclosed subject matter. The transduction element 100 may be mounted to the base plate 310. The transduction element 100 may be positioned to cover the electrical contact 312 and to not cover the electrical contact 314. The transduction element 100 may be positioned so that the center of the piece of piezoelectric material 120 is at the center of the base plate 310.

Figure 7B:
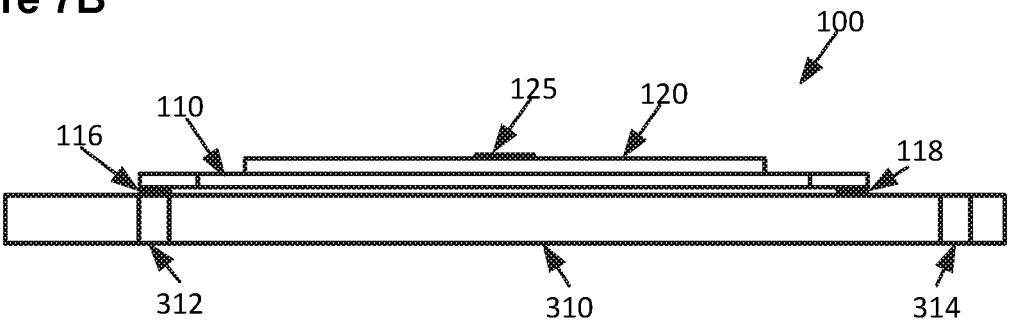
FIG. 7B shows an example cross-sectional view of a transduction element and base plate according to an implementation of the disclosed subject matter.

FIG. 7B shows an example cross-sectional view of a transduction element and base plate according to an implementation of the disclosed subject matter. The transduction element 100 may be positioned on the base plate 310 so that the adhesive 116 on the elastic layer 110 may be in contact with the electrical contact 312 of the base plate 310. The transduction element 100 may be electrically connected to the electrical contact 312. The adhesive 118 may be in contact with the body of the base plate 310. The transduction element 100 may be mounted directly onto the base plate 310 so that any portion of the bottom of surface of the elastic layer 110 that is not covered by adhesive 116 or adhesive 118 rests directly on the base plate 310. The adhesive 116 and the adhesive 118 may bond the transduction element 100 to the base plate 310 and may allow the elastic layer 110 to rest on the base plate 310.

Figure 8A:
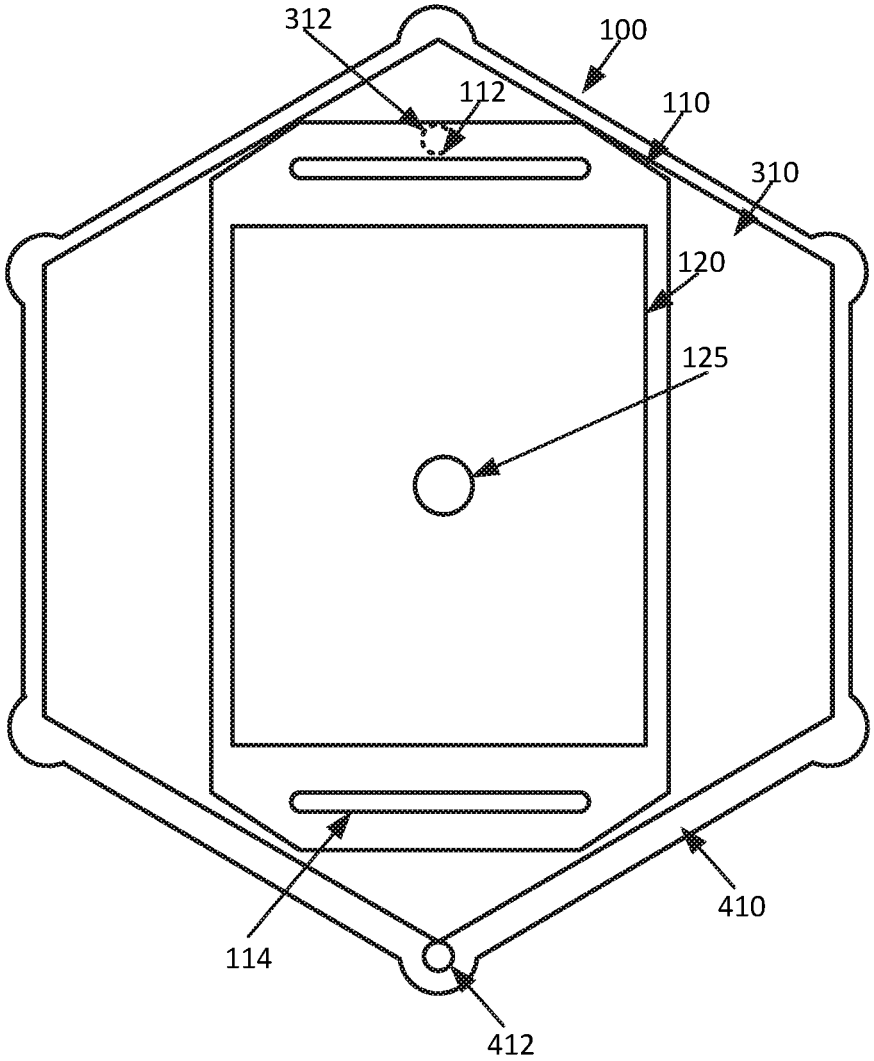
FIG. 8A shows an example transduction element, base plate, and spacer according to an implementation of the disclosed subject matter.

FIG. 8A shows an example transduction element, base plate, and spacer according to an implementation of the disclosed subject matter. The spacer 410 may be mounted to the base plate 310 around the transduction element 100. The spacer 410 may align with the base plate 310. For example, the perimeter of the spacer 410 may have the same shape and size as the perimeter of the base plate 310. The perimeter of the spacer 410 may also be smaller than the perimeter of the base plate 310, allowing the base plate 310 to jut out underneath the spacer 410, or may be larger than the perimeter of the base plate 310, overhanging the base plate 310.

Figure 8B:
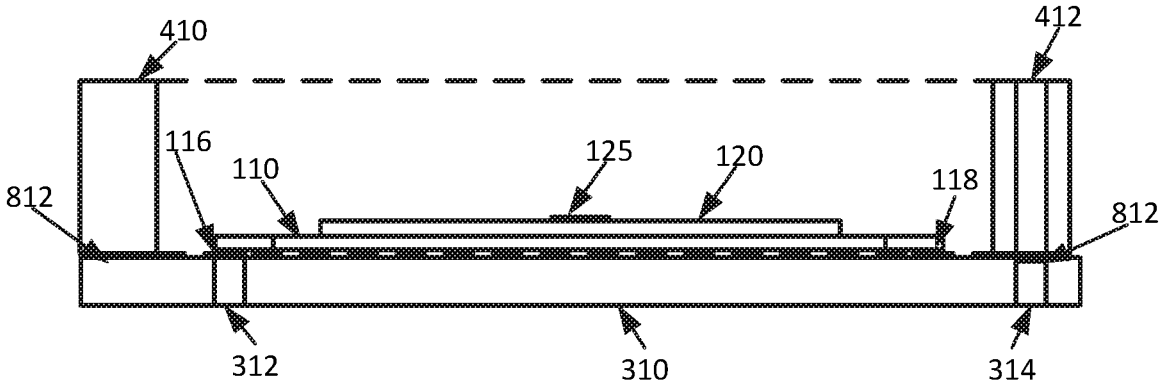
FIG. 8B shows an example cross-sectional view of transduction element, base plate, and spacer according to an implementation of the disclosed subject matter.

FIG. 8B shows an example cross-sectional view of a transduction element, base plate, and spacer according to an implementation of the disclosed subject matter. The spacer 410 may be mounted to the base plate 310 in any suitable manner, including, for example, using adhesive 812 around the bottom perimeter of the spacer 410. The adhesive 812 may be electrically conductive. The spacer 410 may be positioned so that the via 412 is aligned with the electrical contact 314 of the base plate 310. The electrically conductive material in the via 412 may be in direct contact with the electrical contact 314 or may be electrically connected to the electrical contact 314 through electrically conductive adhesive 812.

Figure 9A:
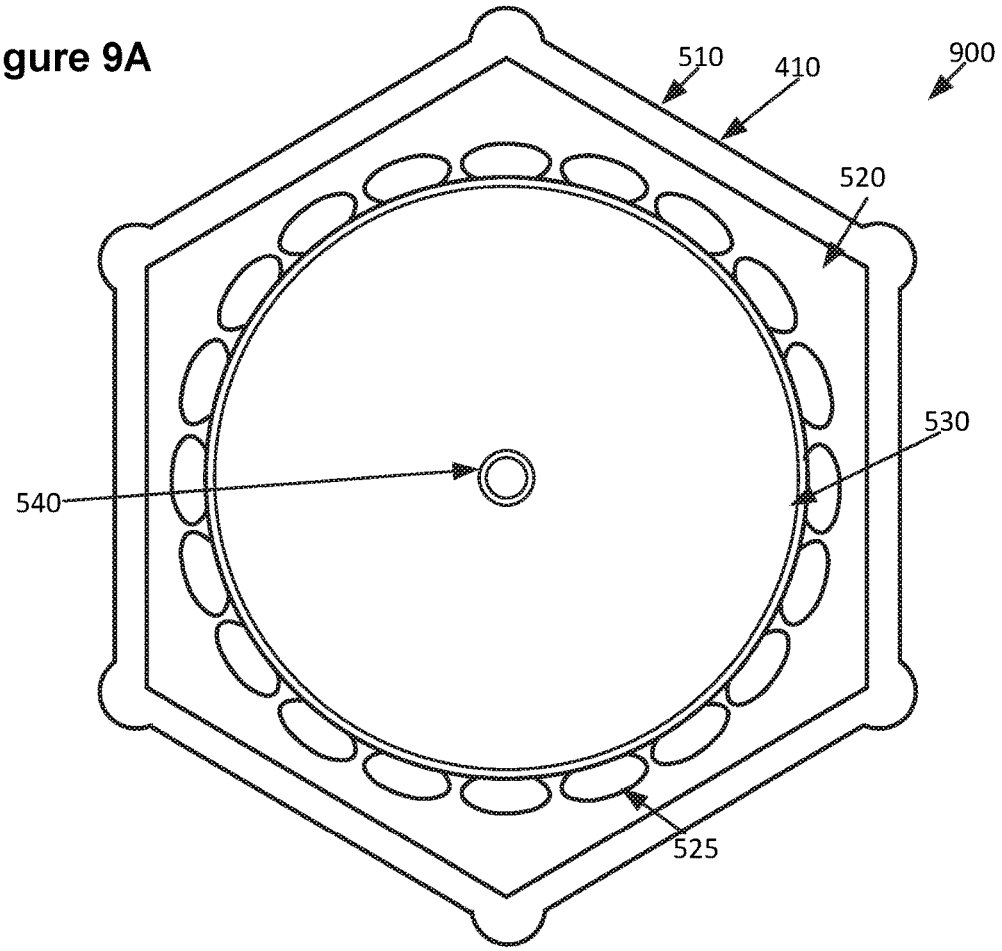
FIG. 9A shows an example piezoelectric transducer according to an implementation of the disclosed subject matter.

FIG. 9A shows an example piezoelectric transducer according to an implementation of the disclosed subject matter. The diaphragm 510 may be mounted onto the piece of piezoelectric material 120 of the transduction element 110 and onto the spacer 410 to form a piezoelectric transducer 900. The diaphragm 510 may be positioned so that the perimeter 520 of the diaphragm 510 is in contact with the top of the spacer 410.

Figure 9B:
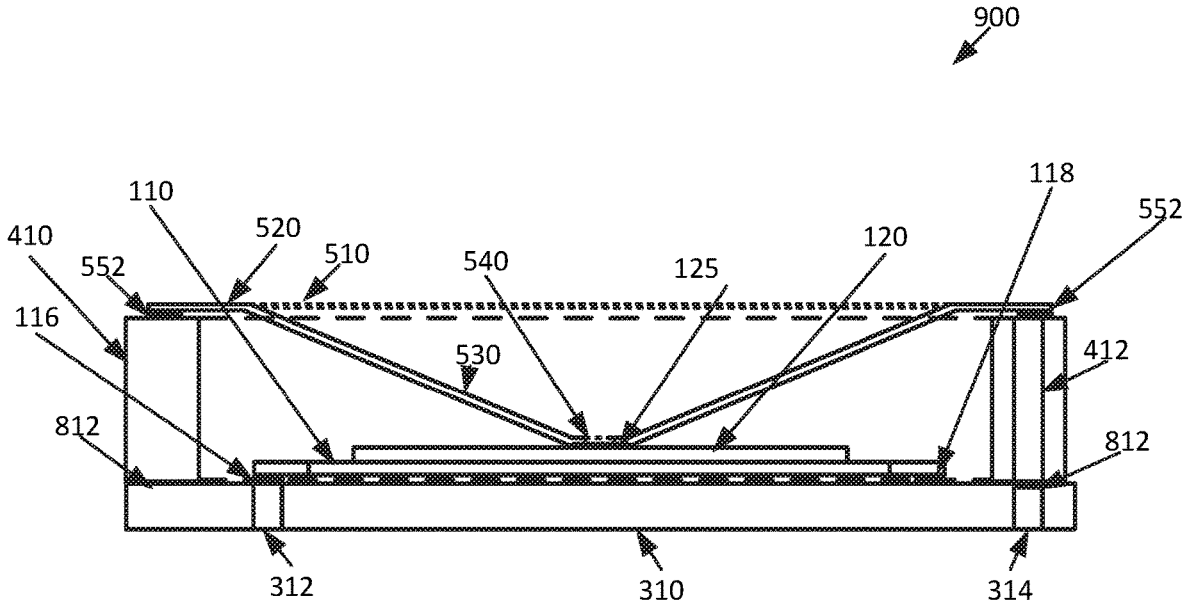
FIG. 9B shows an example cross-sectional view of a piezoelectric transducer according to an implementation of the disclosed subject matter.

FIG. 9B shows an example cross-sectional view of a piezoelectric transducer according to an implementation of the disclosed subject matter. The adhesive 552 around the underside of the perimeter 520 of the diaphragm 510 may be used to bond the perimeter 520 to the top of the spacer 410. The adhesive 552 may be electrically conductive and may create an electrical connection between the electrically conductive material in the via 412 and the diaphragm 510. The cup 530 of the diaphragm 510 may take up a portion of the space between the walls of the spacer 410 above the transduction element 100. The adhesive 125 may bond the center of the bottom of the diaphragm 510 around the cutout 540 to the piece of piezoelectric material 120 of the transduction element 100. The adhesive 125 may be electrically conductive and may electrically connect the diaphragm 510 to the piece of piezoelectric material 120 of the transduction element 100. The bond between the diaphragm 510 and the piece of piezoelectric material 120 may allow motion to be transmitted between the transduction element 100 and the diaphragm 510. For example, an electrical voltage applied to the transduction element 100 may cause the piece of piezoelectric material 120 to flex, which in turn may cause the diaphragm 510 to flex and generate waves in a medium that the diaphragm 510 is contact with, for example, sound waves if the diaphragm 510 is contact with the air. Waves, such as sound waves, that reach the diaphragm 510 may cause the diaphragm 510 to flex, which in turn may cause the transduction element 100 to flex, generating an electrical voltage through the flexure of the piece of piezoelectric material 120.

The electrical contacts 312 and 314 may be connected to a power source, power storage, and/or electrical load. An electrical circuit may be formed between the power source, power storage, and/or electrical load through the electrical 314, the adhesive 812, the via 412, the adhesive 552, the diaphragm 510, the adhesive 125, the transduction element 100, the adhesive 116, and the electrical contact 312. The electrical circuit may include any other suitable electric or electronic components for controlling, supplying power to, and receiving power from, the transduction element 100. Electrical voltage may be supplied to the transduction element 100 through this electrical circuit, causing the piece of piezoelectric material 120 to flex which may in turn cause the diaphragm 510 to flex, generating wave such as soundwaves. Flexure of the piece of piezoelectric material 120 caused by flexure of the diaphragm 510, for example, due to sound waves entering the cup 530, may generate an electrical voltage in the electrical circuit that may be stored in any suitable power storage and/or may be used to supply electrical power to any electrical load.

Figure 9C:
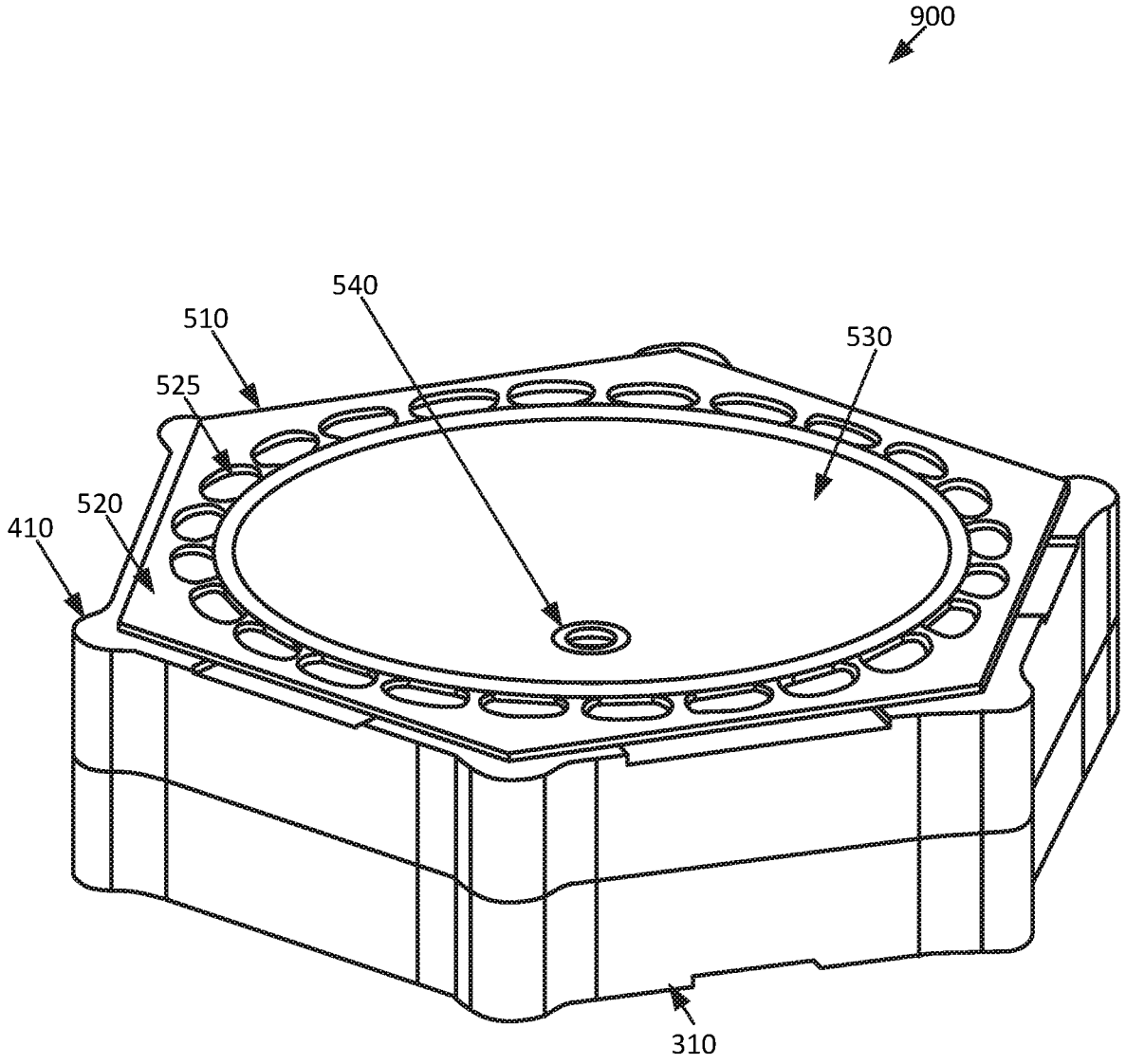
FIG. 9C shows an example piezoelectric transducer according to an implementation of the disclosed subject matter.

FIG. 9C shows an example piezoelectric transducer according to an implementation of the disclosed subject matter. The spacer 410 may align with the base plate 310. The perimeter 520 of the diaphragm 510 may be adhered to the top of the spacer 410 but may not cover the entirety of the top of the spacer 410. The cup 530 may sink down into the piezoelectric transducer 900 so that the cutout 540 may be adhered to the transduction element 100. In some implementations, the diaphragm 510 and the spacer 410 may be a single integral piece formed out of an electrically conductive material.

Figure 10A:
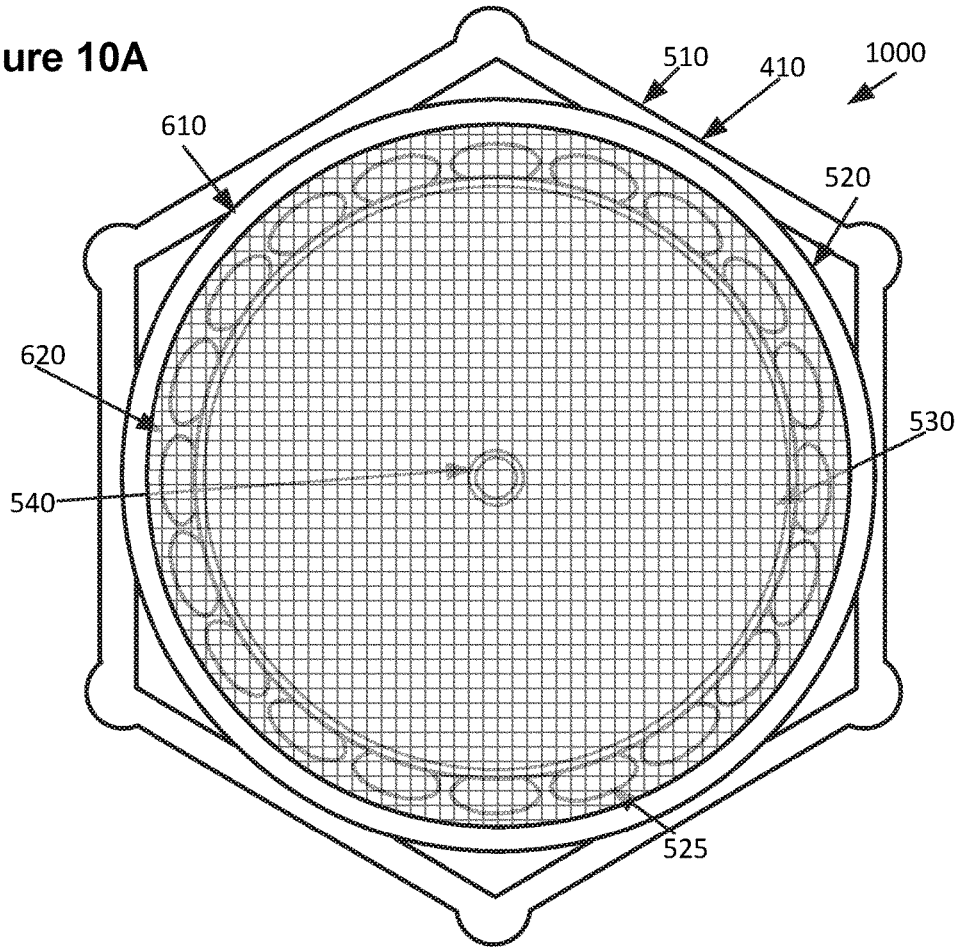
FIG. 10A shows an example piezoelectric transducer according to an implementation of the disclosed subject matter.

FIG. 10A shows an example piezoelectric transducer according to an implementation of the disclosed subject matter. In some implementations, the waveguide 610 and the protection grid 620 may be attached to the diaphragm 510 to form a piezoelectric transducer 1000. The waveguide 610 may be attached to the perimeter 520 of the diaphragm 510 in any suitable manner, including, for example, through the use of any suitable adhesives or be mounted on the spacer 410. The waveguide 610 may be open at its center such that the waveguide 610 does not overhang or block the cup 530. In some implementations, the waveguide 610 and diaphragm 510 may be a single integral piece.

Figure 10B:
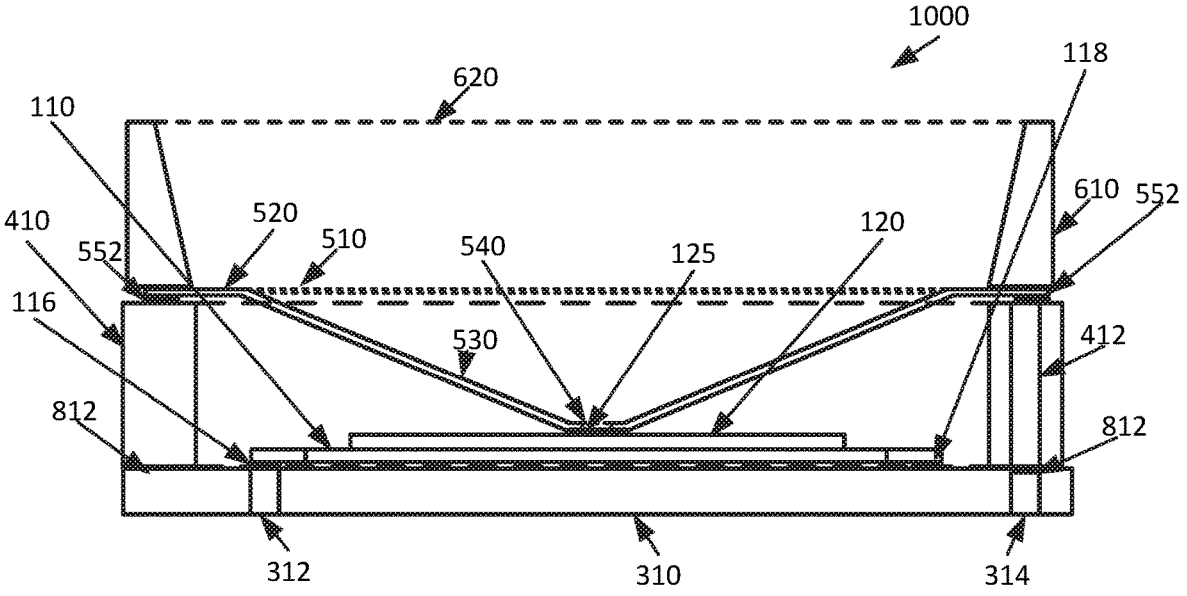
FIG. 10B shows an example cross-sectional view of a piezoelectric transducer according to an implementation of the disclosed subject matter.

FIG. 10B shows an example cross-sectional view of a piezoelectric transducer according to an implementation of the disclosed subject matter. The protection grid 620 may cover the cup 530 of the diaphragm 510. This may protect the cup 530 from foreign objects while still allowing coupling between the cup 530 and a transmission medium, such as, for example, air.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A piezoelectric transducer comprising:

a base plate comprising a first electrical contact and a second electrical contact;

a transduction element mounted directly on the base plate and electrically connected to the first electrical contact;

a spacer comprising a via, the via comprising electrically conductive material, wherein the spacer is mounted on the base plate around the transduction element and the electrically conductive material of the via is electrically connected to the second electrical contact; and a diaphragm mounted on the spacer and on the transduction element, wherein an electrically conductive adhesive bonds the spacer to the base plate and electrically connects the electrically conductive material in the via to the second electrical contact.

2. The piezoelectric transducer of claim 1, wherein an electrically conductive adhesive bonds the transduction element to the base plate and electrically connects the transduction element to the first electrical contact.

3. The piezoelectric transducer of claim 1, wherein an electrically conductive adhesive bonds the diaphragm to the transduction element and electrically connects the diaphragm to the transduction element.

4. The piezoelectric transducer of claim 1, wherein an electrically conductive adhesive bonds the diaphragm to the spacer and electrically connects the diaphragm to the electrically conductive material in the via.

5. The piezoelectric transducer of claim 1, wherein the transduction element comprises a piece of piezoelectric material and an elastic layer.

6. The piezoelectric transducer of claim 1, further comprising a waveguide mounted on the diaphragm above the spacer or mounted directly on the spacer.

7. The piezoelectric transducer of claim 6, further comprising a protection grid attached to the waveguide such that the protection grid is above a cup of the diaphragm.

8. The piezoelectric transducer of claim 6, wherein the waveguide and the diaphragm are a single integral piece.

9. The piezoelectric transducer of claim 6, wherein the waveguide and the spacer are a single integral piece or the spacer and the diaphragm are a single integral piece.

10. The piezoelectric transducer of claim 1, wherein the diaphragm comprises a perimeter and a cup, and wherein the perimeter comprises cutouts around the circumference of the cup and the cup comprises a cutout at the center of the cup.

11. The piezoelectric transducer of claim 1, wherein the diaphragm comprises an electrically conductive material.

12. The piezoelectric transducer of claim 1, wherein the transduction element covers the first electrical contact and does not cover the second electrical contact.

13. The piezoelectric transducer of claim 1, wherein the spacer covers the second electrical contact.

14. A piezoelectric transducer comprising:

a base plate comprising a first electrical contact and a second electrical contact;

a transduction element comprising an elastic layer and a piece of piezoelectric material, wherein the elastic layer is mounted directly on the base plate and electrically connected to the first electrical contact through electrically conductive adhesive;

a spacer comprising a via, the via comprising electrically conductive material, wherein the spacer is mounted on the base plate around the transduction element and the electrically conductive material of the via is electrically connected to the second contact through electrically conductive adhesive; and a diaphragm comprising a perimeter and a cup, wherein the perimeter is mounted on the spacer, the cup is mounted on the piece of piezoelectric material, and the cup is electrically connected to the piece of piezoelectric material through electrically conductive adhesive, wherein the transduction element covers the first electrical contact and the spacer covers the second electrical contact.

15. The piezoelectric transducer of claim 14, further comprising a waveguide mounted to the perimeter of the diaphragm or mounted directly on the spacer.

16. The piezoelectric transducer of claim 15, further comprising a protection grid attached to the waveguide above the cup of the diaphragm.

17. The piezoelectric transducer of claim 14, wherein the diaphragm comprises an electrically conductive material.

* * * * *